US009954284B1

(12) United States Patent
White et al.

(10) Patent No.: US 9,954,284 B1
(45) Date of Patent: Apr. 24, 2018

(54) SKYLIGHT ANTENNA

(71) Applicant: HRL LABORATORIES, LLC, Malibu, CA (US)

(72) Inventors: Carson R. White, Agoura Hills, CA (US); Daniel J. Gregoire, Thousand Oaks, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 13/931,097

(22) Filed: Jun. 28, 2013

(51) Int. Cl.
*H01Q 9/04* (2006.01)

(52) U.S. Cl.
CPC ..... *H01Q 9/045* (2013.01)

(58) Field of Classification Search
CPC ..... H01Q 9/045
USPC ..... 343/713, 700
See application file for complete search history.

(56) References Cited

U.S. PATENT DOCUMENTS

| | | | | |
|---|---|---|---|---|
| 4,630,064 | A | 12/1986 | Andrews et al. | |
| 5,227,807 | A | 7/1993 | Bohlman et al. | |
| 5,572,228 | A | 11/1996 | Manasson et al. | |
| 5,619,218 | A | 4/1997 | Salvail et al. | |
| 5,712,647 | A | 1/1998 | Shively | |
| 6,369,778 | B1 | 4/2002 | Dockery | |
| 6,466,177 | B1 | 10/2002 | Kunysz | |
| 7,218,281 | B2 | 5/2007 | Sievenpiper | |
| 7,427,961 | B2 * | 9/2008 | Song | H01Q 1/1271 343/711 |
| 7,830,310 | B1 * | 11/2010 | Sievenpiper | H01Q 1/38 343/700 MS |
| 7,898,498 | B2 | 3/2011 | Higashi et al. | |
| 7,911,407 | B1 | 3/2011 | Fong | |
| 8,830,129 | B2 * | 9/2014 | Gregoire | H01Q 13/28 343/700 MS |
| 2007/0001909 | A1 | 1/2007 | Sievenpiper | |
| 2009/0002240 | A1 * | 1/2009 | Sievenpiper | H01Q 9/30 343/700 MS |
| 2010/0156749 | A1 | 6/2010 | Kim | |
| 2011/0209110 | A1 | 8/2011 | Grbic et al. | |
| 2012/0068896 | A1 * | 3/2012 | White | H01Q 1/1271 343/713 |

(Continued)

FOREIGN PATENT DOCUMENTS

| | | |
|---|---|---|
| JP | 05-199034 | 8/1993 |
| JP | 06-069717 | 3/1994 |
| JP | 08-008638 | 1/1996 |

(Continued)

OTHER PUBLICATIONS

D. Gregoire and J. Colburn, "Artificial impedance surface antenna design and simulation", Proc. 2010 Antenna Applications Symposium, pp. 288.

(Continued)

*Primary Examiner* — Dameon E Levi
*Assistant Examiner* — Walter Davis
(74) *Attorney, Agent, or Firm* — Ladas & Parry

(57) ABSTRACT

A dielectric artificial impedance surface antenna (DAISA) including a first dielectric with a thickness, the first dielectric thickness varying to provide a modulated impedance to a signal traversing the first dielectric, the first dielectric having a first surface and a second surface opposite the first surface, and a transparent conductive material coating the second surface.

26 Claims, 11 Drawing Sheets

30

(56) References Cited

U.S. PATENT DOCUMENTS

2012/0194399 A1 8/2012 Bily et al.

FOREIGN PATENT DOCUMENTS

| | | |
|---|---|---|
| JP | 07-142916 | 6/2005 |
| JP | 06-112730 | 4/2014 |
| KR | 10-2004-0026205 | 3/2004 |
| TW | 200711221 | 3/2007 |

OTHER PUBLICATIONS

J. S. Colburn et al., "Scalar and Tensor Artificial Impedance Surface Conformal Antennas", 2007 Antenna Applications Symposium, pp. 526-540.

B.H. Fong et al, "Scalar and Tensor Holographic Artificial Impedance Surfaces", IEEE Trans. Antennas Propag., accepted for publication, 20.

U.S. Appl. No. 13/752,195, Gregoire.

From U.S. Appl. No. 13/752,195, Application and Office Actions.

From U.S. Appl. No. 13/427,682, Application and Office Actions including but not limited to the Office Action dated Jan. 30, 2014.

From U.S. Appl. No. 14/092,276, Application and Office Actions.

PCT International Preliminary Report on Patentability (Chapter II) dated Feb. 7, 2014 for related PCT Application No. PCT/US2013/031079.

PCT International Search Report and Written Opinion dated Jun. 27, 2013 for related PCT Application No. PCT/US2013/031079.

Fong, "Scalar and Tensor Holographic Artificial Impedance Surfaces," IEEE TAP., 58, 2010.

Gregoire and Colburn, *Artificial impedance surface antenna design and simulation*, Proc. Antennas Appl. Symposium 2010, pp. 288-303.

Gregoire and Colburn, *Artificial impedance surface antennas*, Proc. Antennas Appl. Symposium 2011, pp. 460-475.

Luukkonen et al, "Simple and accurate analytical model of planar grids and high-impedance surfaces comprising metal strips or patches", IEEE Trans. Antennas Prop., vol. 56, 1624, 2008.

Minatti and Maci et al, "Spiral Leaky-Wave Antennas Based on Modulated Surface Impedance", IEEE Trans. on Antennas and Propagation, vol. 59, No. 12, Dec. 2011.

Patel, A.M.; Grbic, A., "A Printed Leaky-Wave Antenna Based on a Sinusoidally-Modulated Reactance Surface," Antennas and Propagation, IEEE Transactions on , vol. 59, No. 6, pp. 2087,2096, Jun. 2011.

Sievenpiper et al, "Holographic AISs for conformal antennas", 29th Antennas Applications Symposium, 2005.

Sievenpiper, 2005 IEEE Antennas and Prop. Symp. Digest, vol. 1B, pp. 256-259, 2005.

R. Collin, Filed theory of guided waves, 2$^{nd}$ Ed., IEEE Press, 1996, pp. 705-708.

International Search Report and Written Opinion from PCT/US2014/064404 dated Feb. 13, 2015.

From European Patent Application No. 13763659.3, EPO Office Action dated Apr. 26, 2016.

From Chinese Patent Application No. 201380004106.2, PRC Office Action dated Oct. 26, 2015 with English summary.

From U.S. Appl. No. 13/427,682 (Now U.S. Pat. No. 8,830,129), Notice of Allowance dated May 5, 2014.

From U.S. Appl. No. 14/092,276 (Now Published as 2015/0145748), Ex Parte Quayle Action mailed on Oct. 27, 2015.

From U.S. Appl. No. 14/092,276 (Now Published as 2015/0145748), Notice of Allowance dated Dec. 9, 2015.

Felix K. Schwering et al., Design of Dielectric Grating Antennas for Millimeter-Wave Applications, IEEE Transactions on Microwave Theory and Techniques, IEEE Service Center, Piscataway, NJ, US, vol. MTT-31, No. 2, pp. 199-209 (Feb. 1, 1983).

Xu Shanjia et al. "Radiation Characteristics of Multilayer Periodic Dielectric Structures", International Journal of Infared and Millimeter Waves, Springer, Dordrecht, NL, vol. 11, No. 9, pp. 1047-1067 (Sep. 1, 1990).

Xu Shanjia et al., Effects of Groove Profile on the Performances of Grating Antennas, Merging Technologies for the 90's, [International Symposium on Antennas and Propagation], IEEE Dallas TX, vol. 4 , pp. 1940-1943, (May 7-11, 1990).

EPO Search Report issued for EPO application No. 13763059.3 dated May 28, 2015.

From U.S. Appl. No. 13/752,195 (now U.S. Publication No. 2014-0208581 Al), Non-Final Rejection dated Nov. 3, 2016.

* cited by examiner $$Z_{SW}(x,y) = X + M\cos(2\pi f_0 / c(nr - x\sin\theta_0))$$

SKYLIGHT ANTENNA

CROSS REFERENCE TO RELATED APPLICATIONS

This application is related to U.S. application Ser. No. 13/427,682, filed Mar. 22, 2012, which is incorporated herein as though set forth in full.

TECHNICAL FIELD

This disclosure relates to artificial impedance surface antennas (AISAs).

BACKGROUND

Prior art artificial impedance surface antennas (AISAs) are described by D. Gregoire and J. Colburn, "Artificial impedance surface antenna design and simulation", Proc. 2010 Antenna Applications Symposium, pp. 288, J. S. Colburn et al., "Scalar and Tensor Artificial Impedance Surface Conformal Antennas", 2007 Antenna Applications Symposium, pp. 526-540, and B. H. Fong et al, "Scalar and Tensor Holographic Artificial Impedance Surfaces", IEEE Trans. Antennas Propag., accepted for publication, 2010.

In the prior art, AISAs are fabricated by printing arrays of metallic patches 26 onto a dielectric substrate, as shown in FIG. 1B. The surface-wave impedance modulation is created by the printed grid of metallic patches, whose size varies according to the desired modulation. To operate properly it is critical that the size and placement of metallic patches maintain a strict dimensional tolerance. The dielectric substrate, upon which the metallic patches in the prior art are printed, is typically a high-cost, a high-frequency circuit board material such as Rogers Corporation RO3010™, which costs typically $150/sq. ft. The process of creating the array of square patches requires costly and time-consuming circuit board etching techniques.

Installation of affordable directive microwave antennas on the exterior of structures ranging from single-family homes to apartment buildings to office buildings and public structures typically involves mounting parabolic dishes or horn antennas such that they stick out from the structure and are easily visible. Many find this unsightly and would prefer a hidden antenna approach. The AISA is an affordable conformal antenna that addresses this need. However, the real estate for conformal antennas may be limited—especially in residential applications. For many applications, such as satellite reception and telecommunications, the best candidate for installation is the roof. This is far from straightforward for roof materials such as tile and even on asphalt-shingle roofs may require either drilling through the roof or running an unsightly cable down the side of the house.

Further, even though satellite dishes have been commonplace for many years, they are still thought of as unsightly. This causes some to forgo satellite television service in favor of other services such as cable television service.

What is needed is an artificial impedance surface antenna (AISA) that can be located on a roof, which is not unsightly and can be installed without harming the roof. The embodiments of the present disclosure answer these and other needs.

SUMMARY

In a first embodiment disclosed herein, a dielectric artificial impedance surface antenna (DAISA) comprises a first dielectric with a thickness, the first dielectric thickness varying to provide a modulated impedance to a signal traversing the first dielectric, the first dielectric having a first surface and a second surface opposite the first surface, and a transparent conductive material coating the second surface.

In another embodiment disclosed herein, a method of fabricating a dielectric artificial impedance surface antenna (DAISA) comprises forming a dielectric with a thickness, the dielectric thickness varying to provide a modulated impedance to a signal traversing the dielectric, the dielectric having a first surface and a second surface opposite the first surface, and coating the second surface with a transparent conductive material.

These and other features and advantages will become further apparent from the detailed description and accompanying figures that follow. In the figures and description, numerals indicate the various features, like numerals referring to like features throughout both the drawings and the description.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1A:
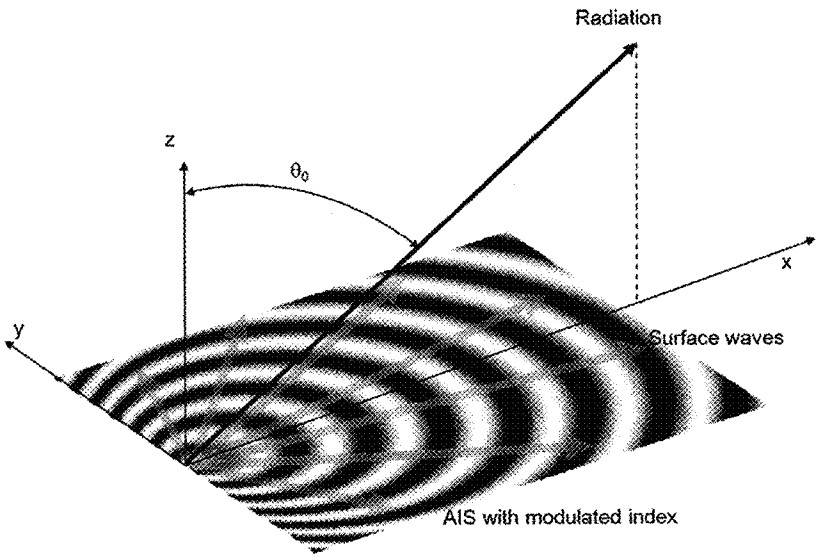
FIG. 1A PRIOR ART
FIG. 1A illustrates the principle for artificial impedance surface antennas in accordance with the prior art.

Artificial impedance surface antennas (AISAs) operate as illustrated in FIG. 1A. A surface wave of a desired frequency is launched across a surface with a modulated impedance. The modulated surface wave impedance of the modulated impedance surface may be described by the following equation.

$$Z_{sw}(x,y)=X+M\cos((2\pi f_0/c)*(nr-x\sin\theta_0))$$

where $Z_{sw}(x,y)$ is the surface wave impedance, x is a one dimension along the surface, y is another dimension along the surface, X is the average impedance, M is the maximum surface wave impedance modulation, $f_0$ is the design frequency of radiation, $n=(1+X^2)^{1/2}$, c is the speed of light, r is the radial distance from the feed point at x=0, y=0, to the coordinates at x, y, and $\theta_0$ is the design angle of radiation.

The modulated surface wave impedance varies the speed of the surface wave as it propagates across the surface. The electric fields generated by the speed variation leads to EM radiation strongly directed into a desired angle $\theta_0$.

Figure 1B:
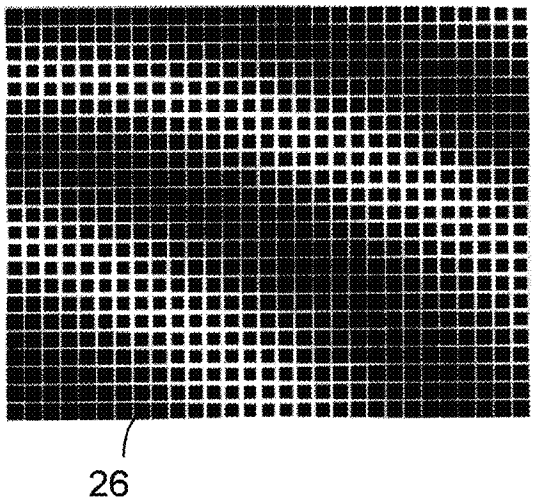
FIG. 1B PRIOR ART
FIG. 1B shows a portion of the artificial impedance surface antenna of FIG. 1A implemented using square metallic patches in accordance with the prior art.

In the prior art, AISAs are fabricated by printing arrays of metallic patches onto a dielectric substrate, which requires strict dimensional tolerance, expensive substrates and costly and time-consuming circuit board etching techniques. FIG. 1B shows a portion of the artificial impedance surface antenna of FIG. 1A implemented using square metallic patches 26 in accordance with the prior art. In FIG. 1B the gaps between the metallic patches 26 vary between 0.2 mm and 1 mm, and high impedance regions have small gaps and are darker.

Figure 3:
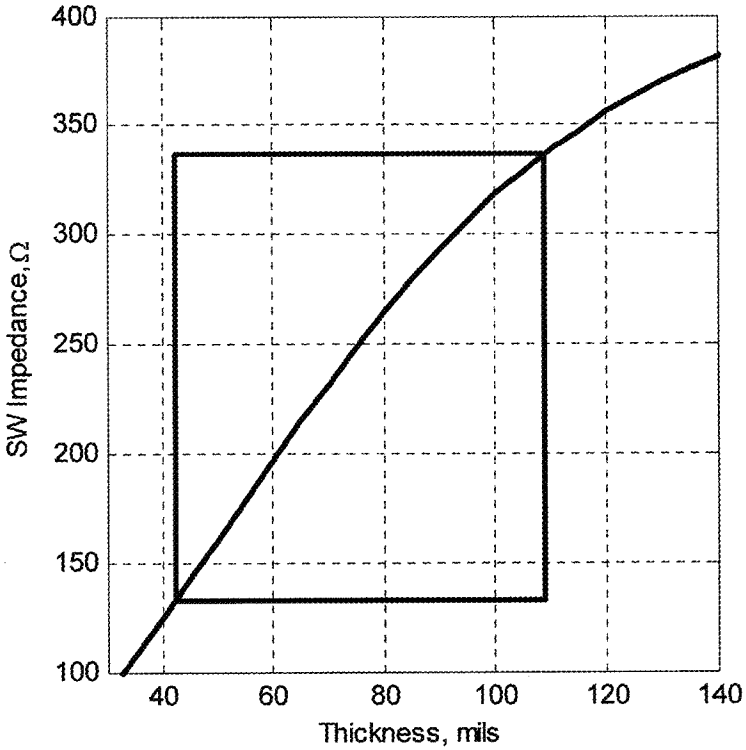
FIG. 3 shows the surface-wave impedance properties of the DAISA of FIG. 2 as a function of its thickness.
Figure 2:
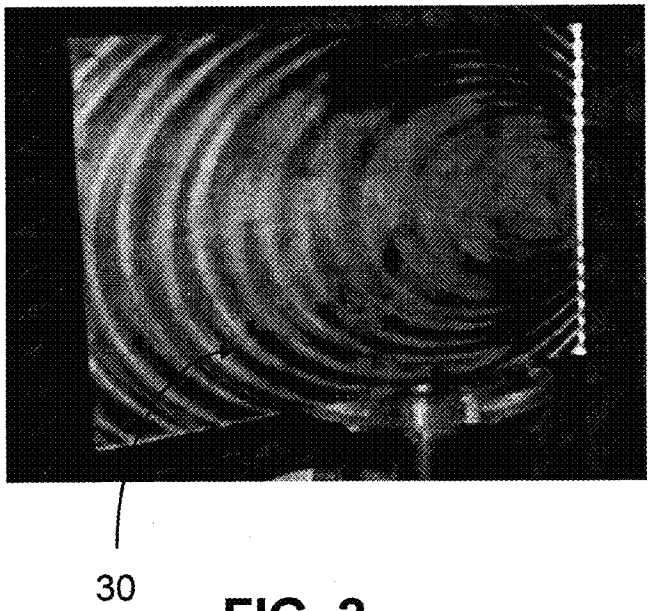
FIG. 2 shows a dielectric artificial impedance surface antenna (DAISA) designed to operate at 24 GHz and radiating predominantly towards 60 degrees off normal.

FIG. 2 shows a dielectric artificial impedance surface antenna (DAISA) designed to operate at 24 GHz and radiating predominantly towards 60 degrees off normal. FIG. 3 shows the surface-wave impedance properties of the DAISA of FIG. 2 as a function of its thickness.

Figure 4A:
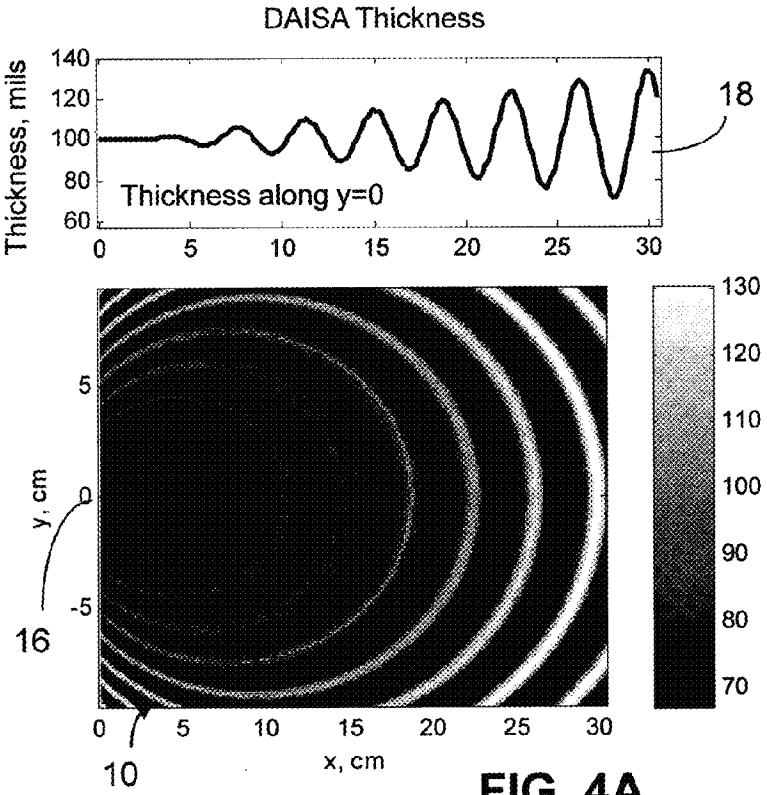
FIG. 4A shows contour and line plots of the thickness of the DAISA of FIG. 2 as a function of position on the DAISA.
Figure 4B:
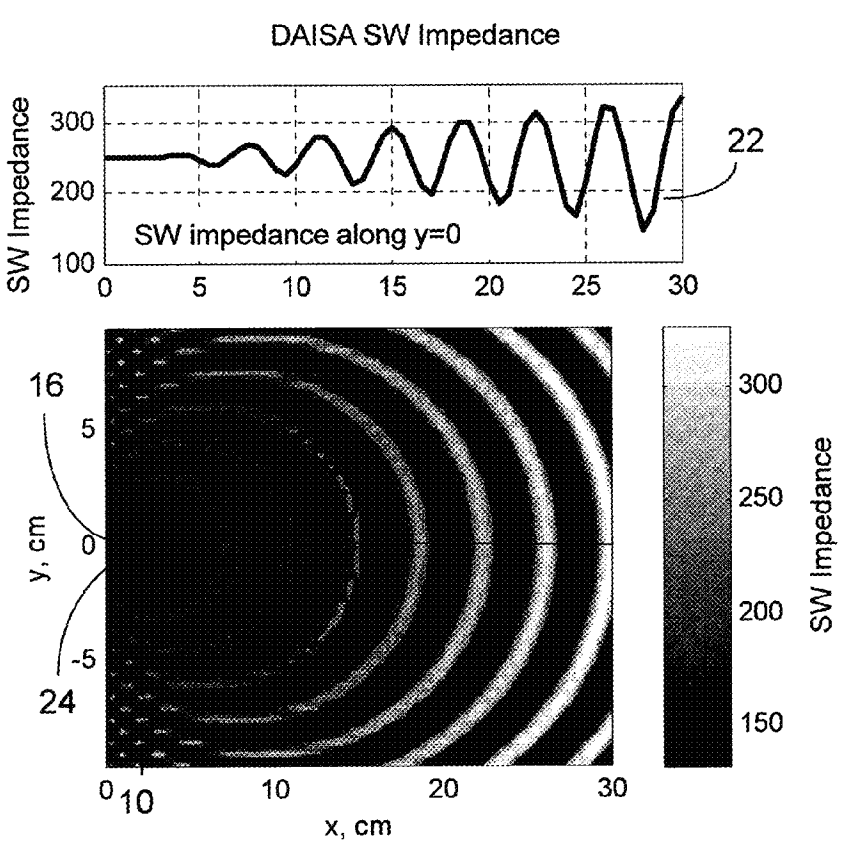
FIG. 4B shows the corresponding contour and line plots of the surface-wave impedance for the DAISA of FIG. 2 as a function of position on the DAISA.
Figure 4C:
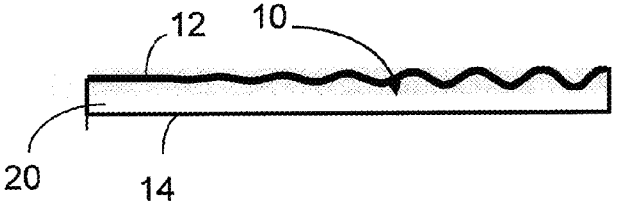
FIG. 4C shows an elevation sectional view of the DAISA of FIG. 2.

FIGS. 4A to 4C show a dielectric artificial impedance surface antenna (DAISA) 10. The DAISA 10 is composed of a sheet of dielectric material 20 that has a modulated thickness that modulates the height of a first surface 12. Modulation diagram 18, shown in FIG. 4A, illustrates how the thickness is modulated. It will be understood by those skilled in the art that a particular modulation depends on the desired frequency and angle of radiation. DAISAs may be designed to radiate at any desired frequency and angle.

The impedance-thickness correlation can be computed using the transverse resonance method. The transverse resonance method for a dielectric sheet is described in R. Collin, "Field theory of guided waves, 2nd Ed.", IEEE Press, 1996, pp. 705-708, which is incorporated herein by reference as though set forth in full.

The DAISA 10 may be planar or have a curvature suitable for conformal mounting on a curved surface, such as, for example, a wing or a nose of an airplane, or a bumper or grill of an automobile. In the case of a planar DAISA, the second surface 14 of the DAISA 10 may be flat. In the case of a conformally mounted DAISA, the second surface 14 may have a curvature suitable for mounting conformally on a curved surface.

The second surface 14 of the DAISA 10 may also have a modulated height.

The dielectric material 20 may be any non-conducting material such as glass or plastic. Example plastic materials include Lexan®, which is a tradename for polycarbonate, acrylic, Plexiglas®, which is a tradename for poly(methyl methacrylate), and other forms of plastic. The dielectric material 20 may be transparent or may be colored.

The dielectric material 20 may have a conducting ground plane on either the first surface 12 or the second surface 14. The ground plane may be formed by depositing metal or otherwise coating one of the surfaces with a metallic coating. In some embodiments of DAISAs, there may be no ground plane on either the first or second surface. In this embodiment, no metal coating is required.

The surface wave impedance map 22 shown in FIG. 4B illustrates the impedance modulation along one line 24 from the feed point 16 of the artificial impedance surface antenna (DAISA) 10. The dielectric artificial impedance surface antenna (DAISA) 10 shown in FIGS. 4A to 4C has a design to radiate at a 60 degree angle off normal at 24 GHz.

Figure 7B:
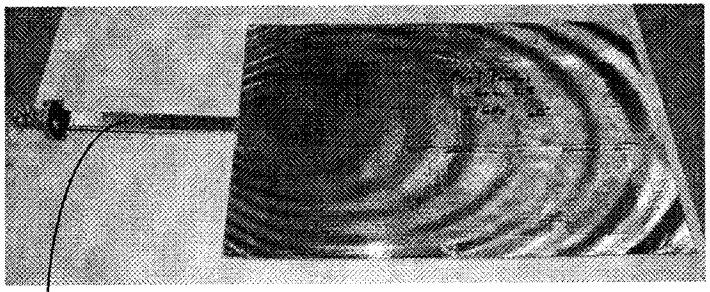
FIGS. 7A and 7B show surface wave feeds for a dielectric artificial impedance surface antenna (DAISA)
Figure 7A:
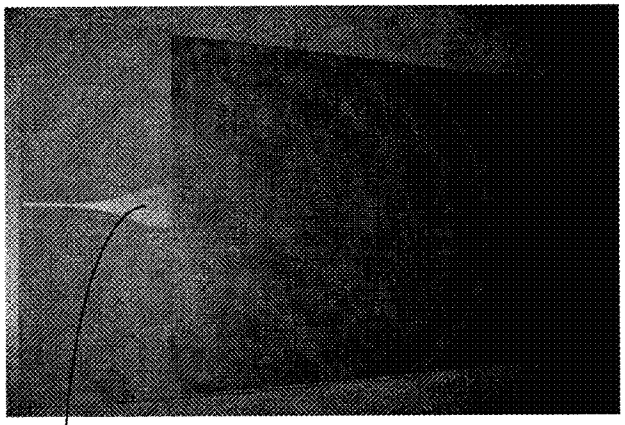

The dielectric artificial impedance surface antenna (DAISA) 10 may be used in either a receive mode or a transmit mode. The surface wave feed, for transmitting a signal to or receiving a signal from the feed point 16 of the DAISA 10 may be a microstrip line 60, as shown in FIG. 7A, a waveguide such as a low profile waveguide 62, shown in FIG. 7B, a microwave horn (not shown), or a dipole extending upward from the first surface 12. The dipole may, for example, be the center conductor of a coaxial cable extending vertically through the feed point and normal to the plane of the DAISA at the feed point 16. The ground conductor of the coaxial cable may be connected to the conducting ground plane, which as discussed above may be either on the first surface 12 or the second surface 14 of the DAISA. The surface-wave feed may launch a transverse magnetic (TM) surface wave or a transverse electric (TE) surface wave.

As described above, FIG. 2 shows a dielectric artificial impedance surface antenna (DAISA) 30 designed to operate at 24 GHz and radiating predominantly towards 60 degrees off normal. The DAISA 30 is fabricated out of 30 cm×20 cm aluminum-backed acrylic. FIG. 3 shows the correlation between the DAISA thickness and the surface-wave impedance. The thickness of DAISA 30 as a function of position is seen in FIG. 4A.

Figure 5B:
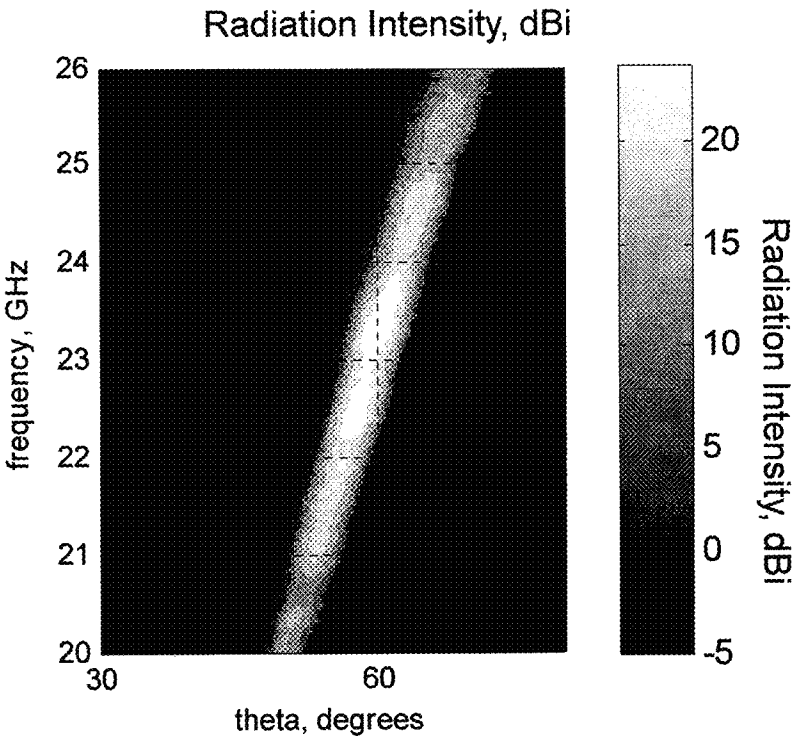
FIG. 5B shows the relative radiation intensity as a function of angle and frequency for the DAISA of FIG. 2.
Figure 5A:
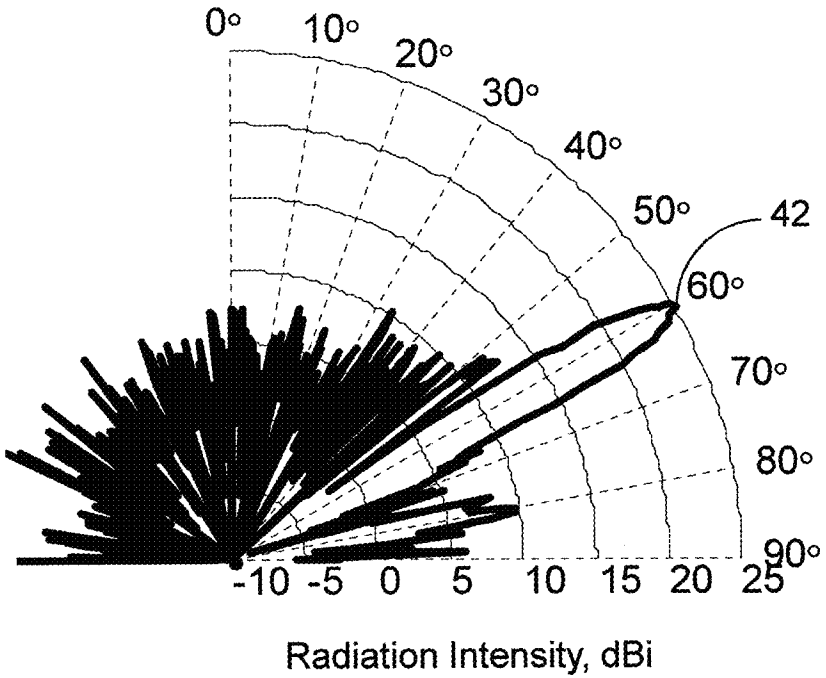
FIG. 5A shows the measured radiation pattern of the DAISA shown in FIG. 2.

FIG. 5A shows the measured realized gain 42 of the radiation pattern of the DAISA 30 shown in FIG. 2. FIG. 53 shows the realized gain as a function of angle and frequency for the DAISA 30.

Figure 6B:
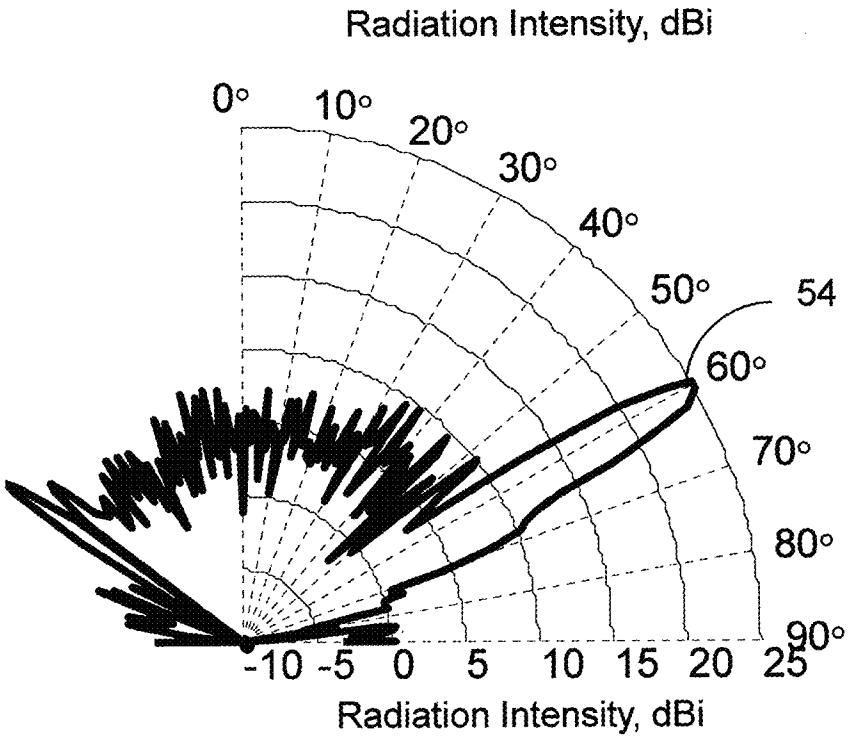
FIG. 6B shows the measured radiation patterns for the DAISA in FIG. 6A.
Figure 6A:
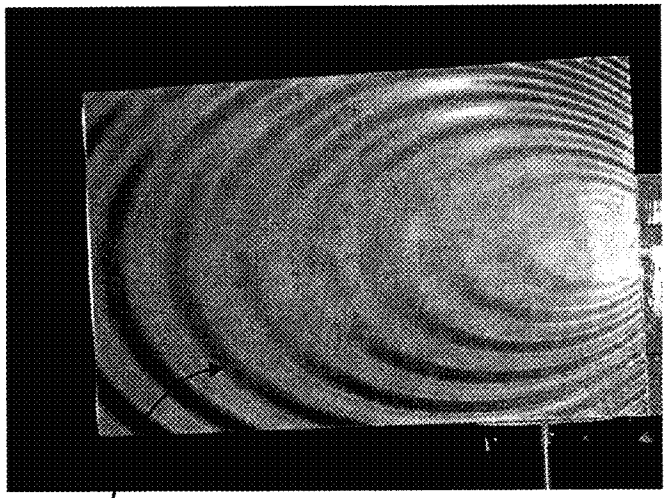
FIG. 6A shows a 60 cm×38 cm DAISA designed to operate at 12 GHz and radiating predominantly towards 60 degrees off normal.

FIG. 6A shows a 60 cm×38 cm DAISA 50 designed to operate at 12 GHz and radiating predominantly towards 60 degrees off normal. FIG. 63 shows the measured realized gain 54 for the DAISA 50.

Figure 8:
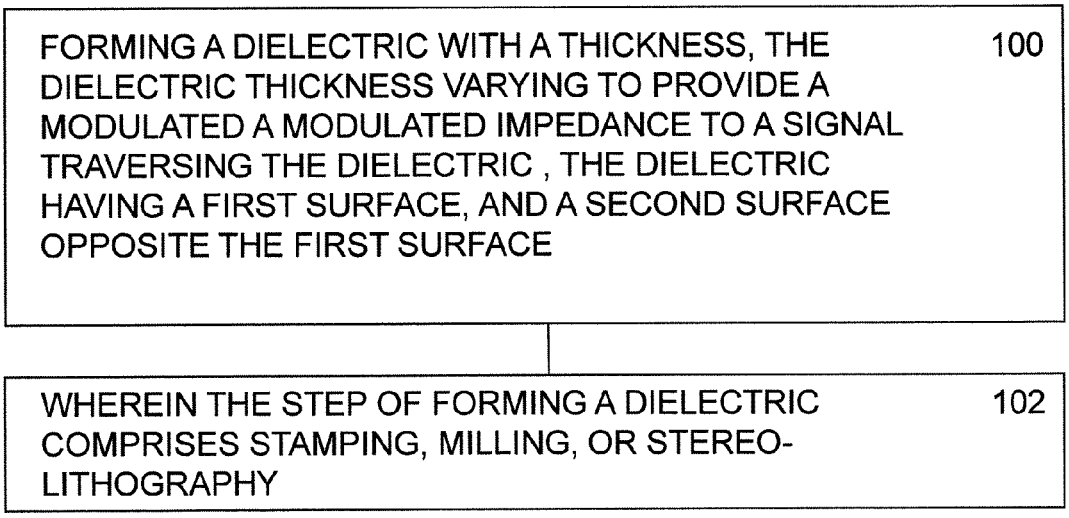
FIG. 8 is a flow diagram of a method of fabricating a dielectric artificial impedance surface antenna (DAISA)

A dielectric artificial impedance surface antenna (DAISA) may be fabricated by forming a dielectric material into a shape to form a modulated impedance surface, as shown in step 100 in FIG. 8. In step 100 a dielectric is formed having a varying thickness to provide a modulated impedance to a signal traversing the dielectric, the dielectric having a first surface and a second surface opposite the first surface.

The shape of the dielectric material may be formed by milling, stereo-lithography or by stamping, which is particularly suited for mass production, as shown in step 102. As discussed above, the dielectric material 20 may be any non-conducting material such as glass or plastic, including Lexan®, acrylic, Plexiglas®, and other forms of plastic. The dielectric material 20 may be transparent or may be colored.

The DAISA may be formed to mount conformally on a curved surface or be planar. A conductive ground plane may be formed on either the first surface 12 or the second surface 14 of the DAISA by metallic coating, which may be sprayed or deposited. Once the DAISA is fabricated a surface wave feed may be attached to the feed point 16 of the DAISA 10.

Skylights are an attractive feature of many residences, reducing lighting costs and improving the atmosphere of living spaces by providing natural light. In addition, some windows incorporate films that reflect infrared heat yet transmit 50% or more of visible light. The present disclosure integrates AISAs into a skylight, hiding both the antenna and cable and providing solar heating control.

Figure 9B:
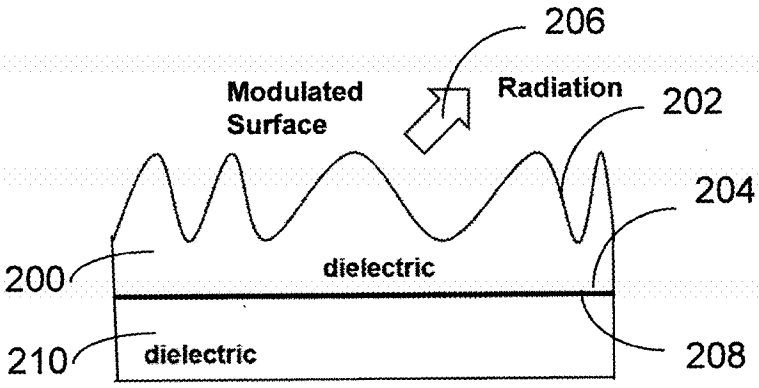
FIGS. 9A-9D show artificial impedance surface antennas (AISAs) in accordance with the present disclosure.
Figure 9A:
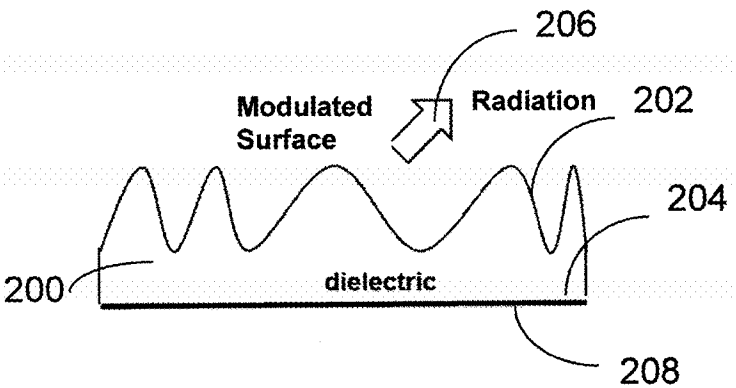

FIGS. 9A-9D show cross sectional views of artificial impedance surface antennas (AISAs) in accordance with the present disclosure that may be integrated with a skylight. The simplest embodiment, as shown in FIG. 9A has a dielectric 200, which may be a single layer of glass. The glass may be common window glass which includes silica ($SiO_2$), or a plastic, including, but not limited to Lexan®, acrylic, Plexiglas®, and other forms of plastic. The dielectric 200 has a thickness between a first surface 202 and a second surface 204 of the dielectric 200 that varies or is modulated to produce a radiation 206 in a desired angle. The second surface 204 is coated with a transparent conductive layer 208, which may be Indium Tin Oxide (ITO), silver based metallic film, or graphene in order to force radiation to be single-sided radiation from only the first surface. The transparent conductive layer 208 also provides solar-heating control.

Another embodiment, shown in FIG. 9B, has two layers of dielectric 200 and 210, both of which may be glass. The first layer 200 has a first surface 202 that has a thickness that varies over a distance to produce a radiation 206 in a desired angle. A second surface 204 of the first layer 200 is coated with a transparent conductive layer 208 such as ITO, a silver film, or graphene in order to force radiation to be single-sided radiation from only the first surface 202. The transparent conductive layer 208 also provides solar-heating control. The second layer 210 of dielectric is laminated onto the transparent conductor layer 208 and may prevent the skylight made of the AISA from shattering or simply to protect the transparent conductor layer 208. The second layer 210 of dielectric may be glass or any dielectric layer, such as a plastic sheet, to protect the transparent conductor layer 208. Also, the first and second layers may together be automotive safety glass.

Figure 9D:
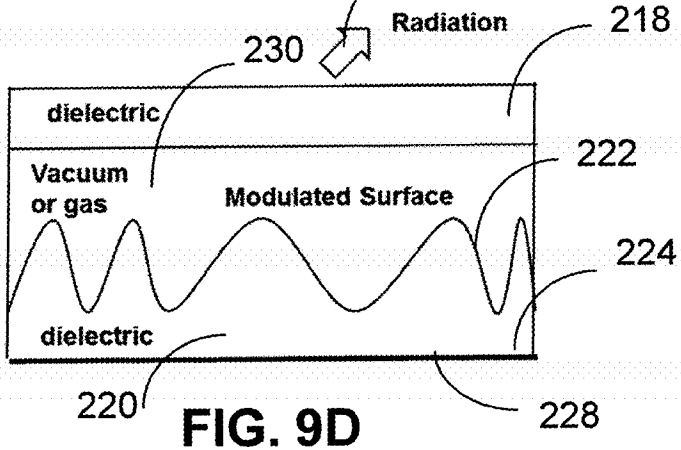
Figure 9C:
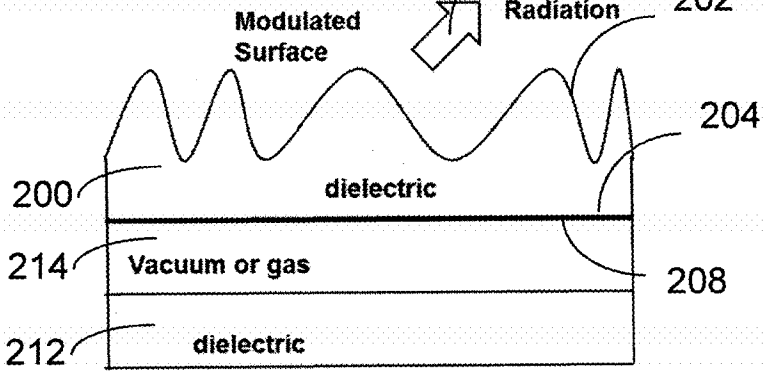

Dual-pane windows having a vacuum or gas between the two panes are often desirable for thermal control. FIGS. 9C and 9D show dual pane AISAs that may be integrated into a skylight.

In FIG. 9C the first layer 200, which may be glass, has a first surface 202 that has a thickness that varies over a distance to produce a radiation 206 in a desired angle. A second surface 204 of the first layer 200 is coated with a transparent conductive layer 208 such as ITO, a silver film, or graphene in order to force radiation to be single-sided radiation from only the first surface.

A second layer 212 of dielectric, which may be glass, is separated from the first layer 200 of dielectric by an enclosed volume 214, which may contain a vacuum or be filled with a gas. The enclosed volume 214 and the transparent conductive layer 208 provide thermal and solar-heating control. As discussed above, the second layer 212 of dielectric may be any dielectric layer, such as glass or a plastic sheet to protect the transparent conductor layer 208.

In FIG. 9D the first layer 218 may be a dielectric, which may be glass, and the first layer 218 may have top and bottom surfaces that are smooth. A second layer 220 of dielectric, which also may be glass, has a first surface 222 that has a thickness 205 that varies over a distance to produce a radiation 206 in a desired angle. A second surface 224 of the second layer 220 is coated with a transparent conductive layer 228 such as ITO, a silver film, or graphene in order to force radiation to be single-sided radiation from only the first surface 222. The first layer 218 is separated from the second layer 220 by an enclosed volume 230, which may be filled with a gas or be a vacuum. As in the embodiment of FIG. 9C, the enclosed volume 230 and the transparent conductive layer 228 provide thermal and solar-heating control. An advantage of the embodiment of FIG. 9D is that the top surface of the first layer, which may be the top of the skylight, may be easier to keep free of debris.

Because the AISAs in FIGS. 9A-9D include dielectric layers, they may be referred to as dielectric AISAs. Also, in all of the above embodiments, the layers of dielectric, such as surfaces 204 and 224, need not be flat or planar, and instead may be curved surfaces.

Figure 10B:
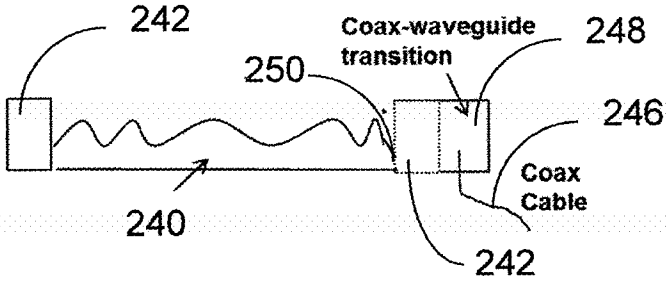
FIGS. 10A-10B show an artificial impedance surface antenna (AISA) with a frame and an integrated feed in accordance with the present disclosure.
Figure 10A:
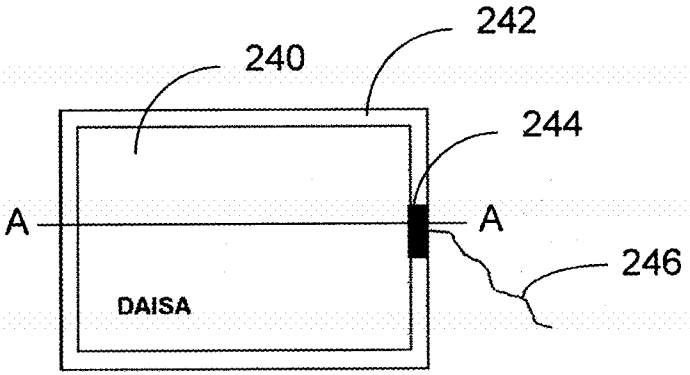

FIG. 10A shows a top view of a dielectric AISA (DAISA) 240, such as the DAISAs of FIGS. 9A-9D, integrated with a frame 242 and an antenna feed 244 connected to a coaxial cable 246. FIG. 10B shows a cross sectional view of FIG. 10A along line A-A showing how a waveguide-type antenna feed 244 may be integrated into the frame 242.

The coaxial cable 246 may interface with communications equipment, such as a satellite television receiver. Multiple coaxial cables and/or wires may be included or a connector assembly may be provided for interfacing with user provided cables. FIG. 10B shows one example of an integrated feed in which an open-ended waveguide 250 is integrated into the window frame 242. The waveguide 250 is connected to a coax-waveguide transition 248 that then interfaces with the coaxial cable 246.

Figure 11:
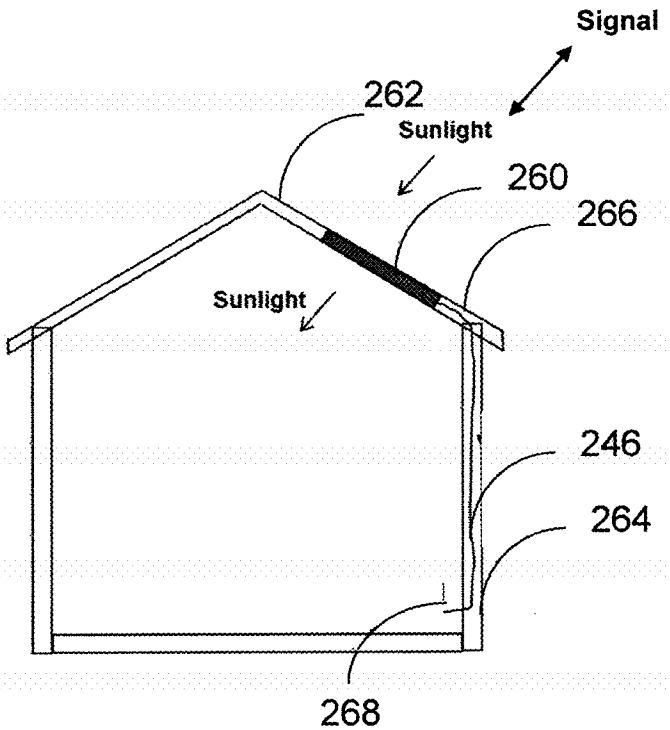
FIG. 11 shows an artificial impedance surface antenna (AISA) integrated into a skylight on a roof of a house in accordance with the present disclosure.

FIG. 11 shows one example of how a DAISA skylight 260 according to FIGS. 9A-9D and 10A-10B may be integrated on a roof 262 of a house in accordance with the present disclosure. The DAISA skylight 260 serves two purposes simultaneously. First, it provides natural light during the daytime, and second, it provides a directional antenna. The DAISA 260 may be operated in receive mode and provide signal to a receiver, such as a satellite television receiver. The signal may emanate from a satellite transmitter or another transmitter, such as a ground transmitter. In another mode, the DAISA 260 may be operated in a transmit mode to transmit information to a receiver, such as a receiver on a satellite.

FIG. 11 shows how the coaxial cable 246 may be routed through the wall 264 to interface with a common cable jack 268 in the house. The coaxial cable 246 may in many cases be routed through the wall 264, and even a space 266 between the rafters of the house, so that the coaxial cable may be hidden from view.

Figure 12:
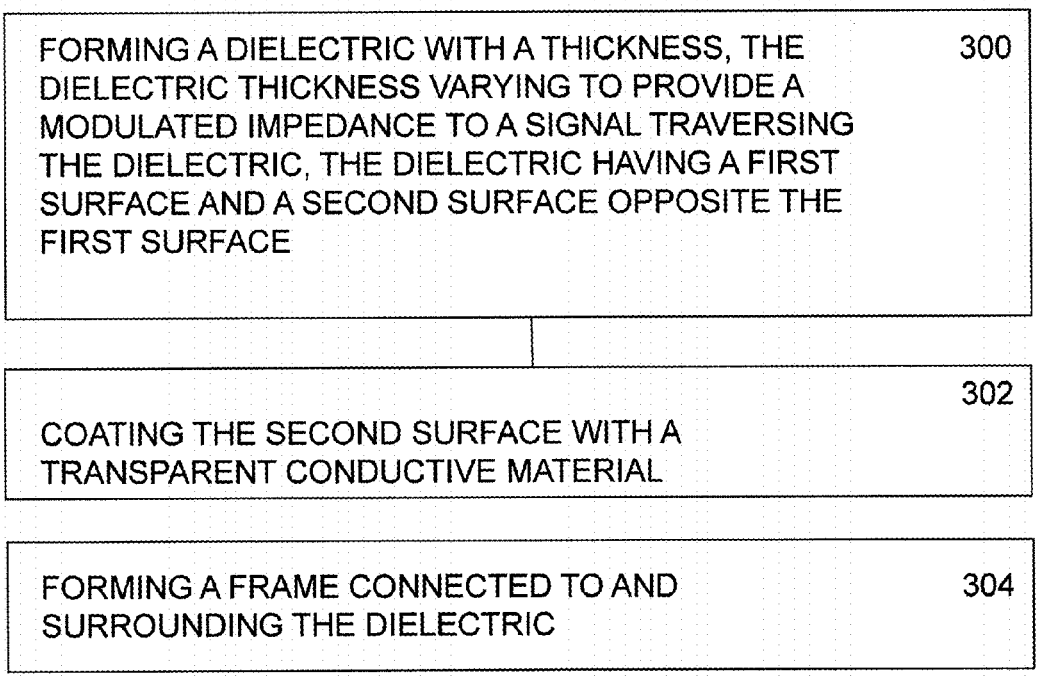
FIG. 12 is a flow diagram of a method of fabricating a dielectric artificial impedance surface antenna (DAISA) in accordance with the present disclosure.

FIG. 12 is a flow diagram of a method of fabricating a dielectric artificial impedance surface antenna (DAISA) in accordance with the present disclosure. In step 300 a dielectric is formed with a thickness, the dielectric thickness varying to provide a modulated impedance to a signal traversing the dielectric, and the dielectric having a first surface and a second surface opposite the first surface. In step 302 the second surface is coated with a transparent conductive material. The method may include step 304 of forming a frame connected to and surrounding the dielectric. The frame may be a frame for a skylight on a roof.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A dielectric artificial impedance surface antenna (DAISA) comprising:

a first dielectric having a thickness;

a frame connected to and surrounding the first dielectric; and a second dielectric connected to and surrounded by the frame;

wherein the thickness of the first dielectric varies between a first surface and a second surface of the first dielectric to provide a modulated impedance to a signal traversing the first dielectric;

wherein the second surface is opposite the first surface;

wherein a conductive material coating is on the second surface;

wherein the conductive material coating is transparent to visible light;

wherein the second dielectric is separated from the first dielectric by a distance; and wherein a volume defined by the distance between the second dielectric and the first dielectric and the frame surrounding the first dielectric and the second dielectric contains a vacuum or a gas.

2. The DAISA of claim 1 wherein the conductive material coating comprises Indium Tin Oxide, silver based metallic film, or graphene.

3. The DAISA of claim 1 wherein the first dielectric comprises glass, plastic, polycarbonate, acrylic, or poly (methyl methacrylate).

4. The DAISA of claim 1 wherein the second dielectric comprises glass, plastic, polycarbonate, acrylic, or poly(methyl methacrylate).

5. The DAISA of claim 1:

wherein the second dielectric is separated from the conductive material coating by a distance; and wherein a volume defined by the distance between the second dielectric and the conductive material coating and the frame surrounding the first dielectric and the second dielectric contains a vacuum or a gas.

6. The DAISA of claim 1:

wherein the second dielectric is separated from the first surface on the first dielectric by a distance; and wherein a volume defined by the distance between the first surface on the first dielectric and the second dielectric and the frame surrounding the first dielectric and the second dielectric contains a vacuum or a gas.

7. The DAISA of claim 1 wherein the frame comprises:

an integrated feed for feeding a signal to the first dielectric.

8. The DAISA of claim 7 wherein:

the integrated feed comprises an open ended waveguide for feeding a signal to the first dielectric;

the open ended waveguide is connected to a coax-waveguide transition; and the coax-waveguide transition is connected to a coaxial cable.

9. The DAISA of claim 1 wherein:

the frame comprises a skylight frame for mounting on a roof.

10. The DAISA of claim 8 wherein:

the frame comprises a skylight frame for mounting on a roof; and the coaxial cable is routed between a wall from the coax-waveguide transition to a connector to hide the coaxial cable from view.

11. The DAISA of claim 10 wherein:

the coaxial cable is routed between rafters supporting the roof to hide the coaxial cable from view.

12. The DAISA of claim 1 wherein the second surface of the first dielectric has a planar or a curved shape.

13. The DAISA of claim 1 further comprising:

a feed point at a location on the first surface; and a surface wave feed coupled to the feed point.

14. The DAISA of claim 13 wherein the surface wave feed comprises a microstrip line, a waveguide, a microwave horn, or a dipole.

15. The DAISA of claim 13 wherein the surface-wave feed is adapted to transmit a transverse magnetic (TM) surface wave across the first surface, or receive a transverse magnetic (TM) surface wave.

16. The DAISA of claim 13 wherein the surface-wave feed is adapted to transmit a transverse electric (TE) surface wave across the first surface, or receive a transverse electric (TE) surface wave.

17. A method of fabricating a dielectric artificial impedance surface antenna (DAISA) comprising:

providing a first dielectric having a thickness;

providing a frame connected to and surrounding the first dielectric; and providing a second dielectric connected to and surrounded by the frame;

wherein the thickness of the first dielectric varies between a first surface and a second surface of the first dielectric to provide a modulated impedance to a signal traversing the first dielectric;

wherein the second surface is opposite the first surface;

wherein the second surface is coated with a conductive material;

wherein the conductive material is transparent to visible light;

wherein the second dielectric is separated from the first dielectric by a distance; and wherein a volume defined by the distance between the second dielectric and the first dielectric and the frame surrounding the first dielectric and the second dielectric contains a vacuum or a gas.

18. The method of claim 17 wherein:

the frame comprises a skylight frame for mounting on a roof.

19. The method of claim 17 wherein the conductive material comprises Indium Tin Oxide, silver based metallic film, or graphene.

20. The method of claim 17 wherein the step of forming the first dielectric comprises stamping, milling, or stereolithography.

21. The method of claim 17 wherein the first dielectric comprises glass, plastic, polycarbonate, acrylic, or poly (methyl methacrylate).

22. The method of claim 17:

wherein the second dielectric is separated from the conductive material by a distance; and wherein a volume defined by the distance between the second dielectric and the conductive material and the frame surrounding the first dielectric and the second dielectric contains a vacuum or a gas.

23. The method of claim 17:

wherein the second dielectric is separated from the first surface on the first dielectric by a distance; and wherein a volume defined by the distance between the first surface on the first dielectric and the second dielectric and the frame surrounding the first dielectric and the second dielectric contains a vacuum or a gas.

24. The method of claim 17 wherein the second dielectric comprises glass, plastic, polycarbonate, acrylic, or poly (methyl methacrylate).

25. A dielectric artificial impedance surface antenna (DAISA) comprising:

a first dielectric having a thickness;

a frame connected to and surrounding the first dielectric; and a second dielectric connected to and surrounded by the frame;

wherein the thickness of the first dielectric varies between a first surface and a second surface of the first dielectric to provide a modulated impedance to a signal traversing the first dielectric;

wherein the second surface is opposite the first surface;

wherein a conductive material coating is on the second surface;

wherein the conductive material coating is transparent to visible light; and wherein the conductive material is a continuous coating over the second surface substantially covering entirely the second surface where the thickness of the first dielectric varies between the first surface and the second surface.

26. A method of providing a dielectric artificial impedance surface antenna (DAISA) comprising:

a first dielectric having a thickness;

a frame connected to and surrounding the first dielectric; and a second dielectric connected to and surrounded by the frame;

wherein the thickness of the first dielectric varies between a first surface and a second surface of the first dielectric to provide a modulated impedance to a signal traversing the first dielectric;

wherein the second surface is opposite the first surface;

wherein a conductive material coating is on the second surface;

wherein the conductive material coating is transparent to visible light; and wherein the conductive material is a continuous coating over the second surface substantially covering entirely the second surface where the thickness of the first dielectric varies between the first surface and the second surface.

* * * * *